US006401252B1

(12) United States Patent
Dean

(10) Patent No.: US 6,401,252 B1
(45) Date of Patent: Jun. 11, 2002

(54) MASSAGING GLOVE ASSEMBLY

(76) Inventor: Charles M. Dean, 9257 S. King Dr., Chicago, IL (US) 60619

( * ) Notice: Subject to any disclaimer, the term of this patent is extended or adjusted under 35 U.S.C. 154(b) by 0 days.

(21) Appl. No.: 09/751,734

(22) Filed: Dec. 29, 2000

(51) Int. Cl.[7] ..... A41D 19/00
(52) U.S. Cl. ..... 2/160; 2/161.6; 2/163
(58) Field of Search ..... 2/158, 159, 160, 2/161.6, 163; 15/227; 119/600

(56) References Cited

U.S. PATENT DOCUMENTS

| | | | | |
|---|---|---|---|---|
| 2,703,571 A | | 3/1955 | Thomas | |
| 4,116,233 A | | 9/1978 | Scaduto | |
| D347,709 S | | 6/1994 | Pearson | |
| 5,554,102 A | | 9/1996 | Chiou | |
| 5,577,273 A | * | 11/1996 | Newkirk et al. | 2/160 |
| 5,601,529 A | | 2/1997 | Wollman | |

FOREIGN PATENT DOCUMENTS

| | | | | |
|---|---|---|---|---|
| GB | 2035052 | * | 6/1936 | 2/161.6 |

* cited by examiner

*Primary Examiner*—Peter Nerbun
*Assistant Examiner*—Katherine M Moran

(57) ABSTRACT

A massaging glove assembly for massaging various areas of a user's body. The massaging glove assembly includes a glove having a hand portion and a plurality of finger portions a thumb portion being extended from the hand portion; and also includes a plurality of balls being movably disposed near ends of the finger portions and the thumb portion; and further includes a vibrating assembly being attached to the glove for vibrating the balls.

8 Claims, 2 Drawing Sheets

MASSAGING GLOVE ASSEMBLY

BACKGROUND OF THE INVENTION

1. Field of the Invention

The present invention relates to a therapeutic glove and more particularly pertains to a new massaging glove assembly for massaging various areas of a user's body.

2. Description of the Prior Art

The use of a therapeutic glove is known in the prior art. More specifically, a therapeutic glove heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,577,273; U.S. Pat. No. 4,116,233; U.S. Pat. No. 5,601,529; U.S. Pat. No. 5,554,102; U.S. Pat. No. 2,703,571; and U.S. Pat. No. Des. 347,709.

While these devices fulfill their respective, particular objectives and requirements, the aforementioned patents do not disclose a new massaging glove assembly. The inventive device includes a glove having a hand portion and a plurality of finger portions a thumb portion being extended from the hand portion; and also includes a plurality of balls being movably disposed near ends of the finger portions and the thumb portion; and further includes a vibrating assembly being attached to the glove for vibrating the balls.

In these respects, the massaging glove assembly according to the present invention substantially departs from the conventional concepts and designs of the prior art, and in so doing provides an apparatus primarily developed for the purpose of massaging various areas of a user's body.

SUMMARY OF THE INVENTION

In view of the foregoing disadvantages inherent in the known types of therapeutic glove now present in the prior art, the present invention provides a new massaging glove assembly construction wherein the same can be utilized for massaging various areas of a user's body.

The general purpose of the present invention, which will be described subsequently in greater detail, is to provide a new massaging glove assembly which has many of the advantages of the therapeutic glove mentioned heretofore and many novel features that result in a new massaging glove assembly which is not anticipated, rendered obvious, suggested, or even implied by any of the prior art therapeutic glove, either alone or in any combination thereof.

To attain this, the present invention generally comprises a glove having a hand portion and a plurality of finger portions a thumb portion being extended from the hand portion; and also includes a plurality of balls being movably disposed near ends of the finger portions and the thumb portion; and further includes a vibrating assembly being attached to the glove for vibrating the balls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new massaging glove assembly which has many of the advantages of the therapeutic glove mentioned heretofore and many novel features that result in a new massaging glove assembly which is not anticipated, rendered obvious, suggested, or even implied by any of the prior art therapeutic glove, either alone or in any combination thereof.

It is another object of the present invention to provide a new massaging glove assembly which may be easily and efficiently manufactured and marketed.

It is a further object of the present invention to provide a new massaging glove assembly which is of a durable and reliable construction.

An even further object of the present invention is to provide a new massaging glove assembly which is susceptible of a low cost of manufacture with regard to both materials and labor, and which accordingly is then susceptible of low prices of sale to the consuming public, thereby making such massaging glove assembly economically available to the buying public.

Still yet another object of the present invention is to provide a new massaging glove assembly which provides in the apparatuses and methods of the prior art some of the advantages thereof, while simultaneously overcoming some of the disadvantages normally associated therewith.

Still another object of the present invention is to provide a new massaging glove assembly for massaging various areas of a user's body.

Yet another object of the present invention is to provide a new massaging glove assembly which includes a glove having a hand portion and a plurality of finger portions a thumb portion being extended from the hand portion; and also includes a plurality of balls being movably disposed near ends of the finger portions and the thumb portion; and further includes a vibrating assembly being attached to the glove for vibrating the balls.

Still yet another object of the present invention is to provide a new massaging glove assembly that is convenient and easy to use to effectively relieve tension and stress.

Even still another object of the present invention is to provide a new massaging glove assembly that saves the user time and soothes and massages aching muscles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
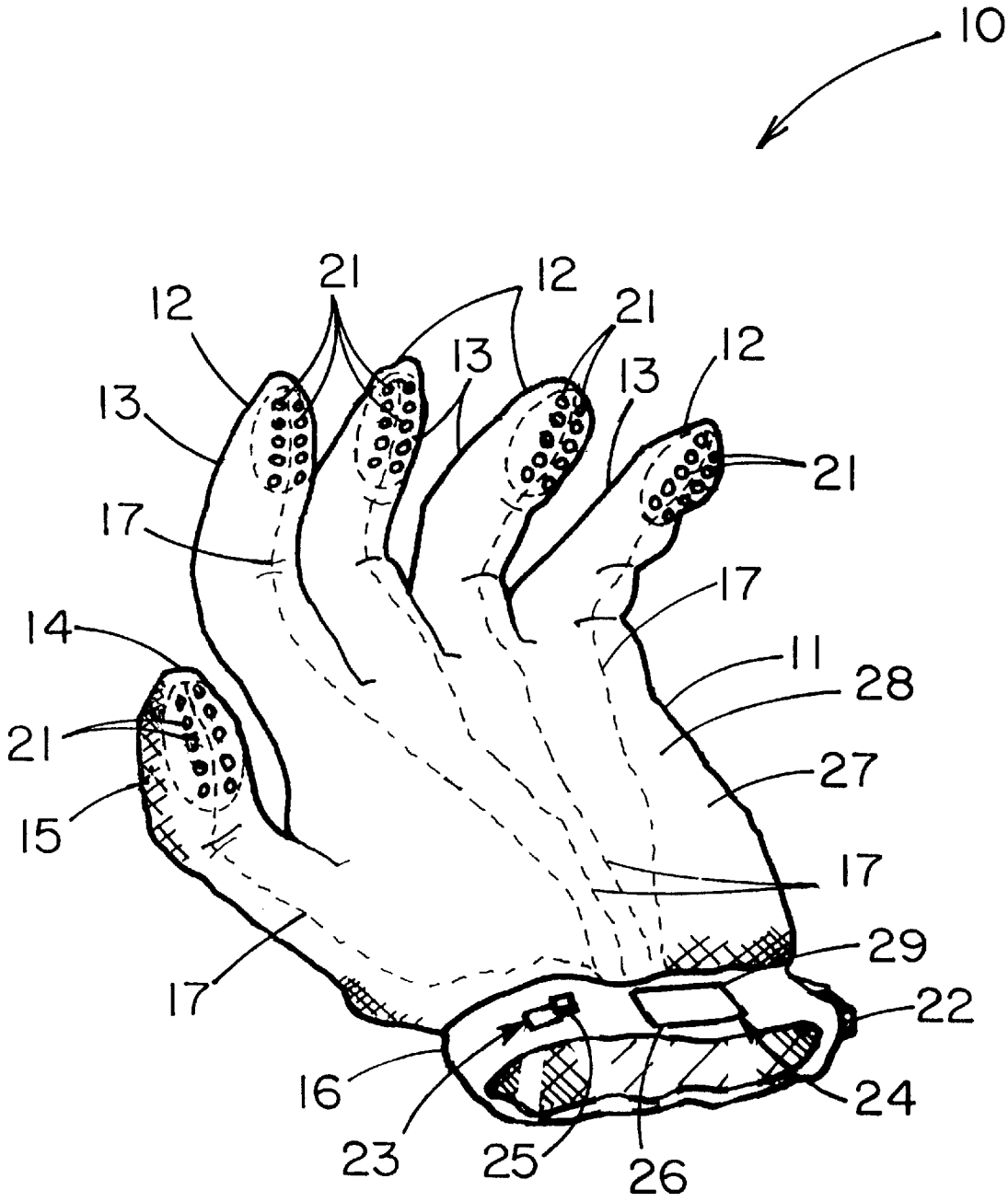
FIG. 1 is a perspective view of a new massaging glove assembly according to the present invention.
Figure 3:
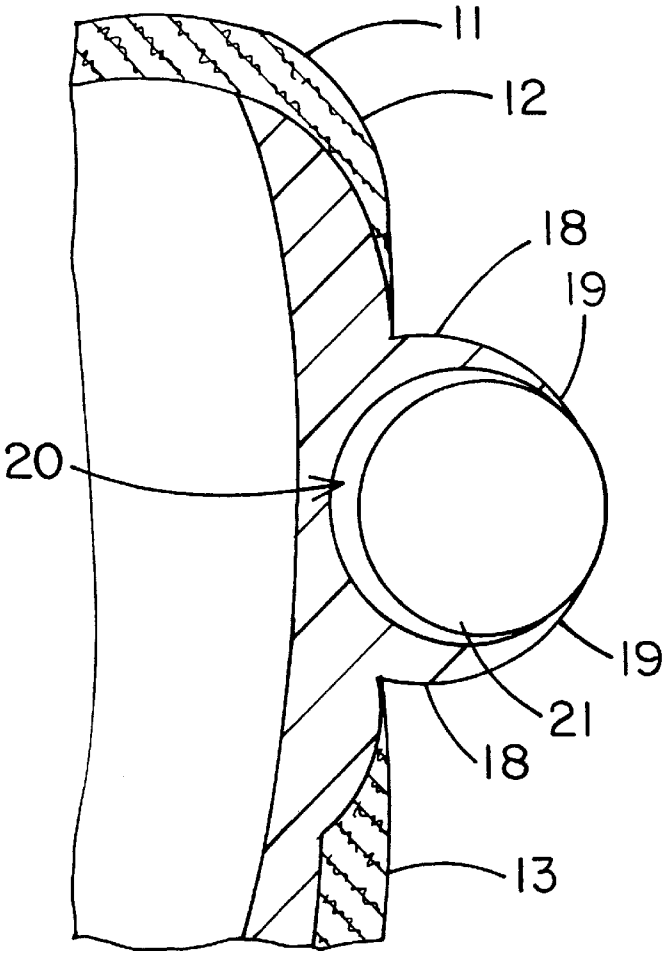
FIG. 3 is a cross sectional view of one of the movable balls and finger portions of the present invention.
Figure 2:
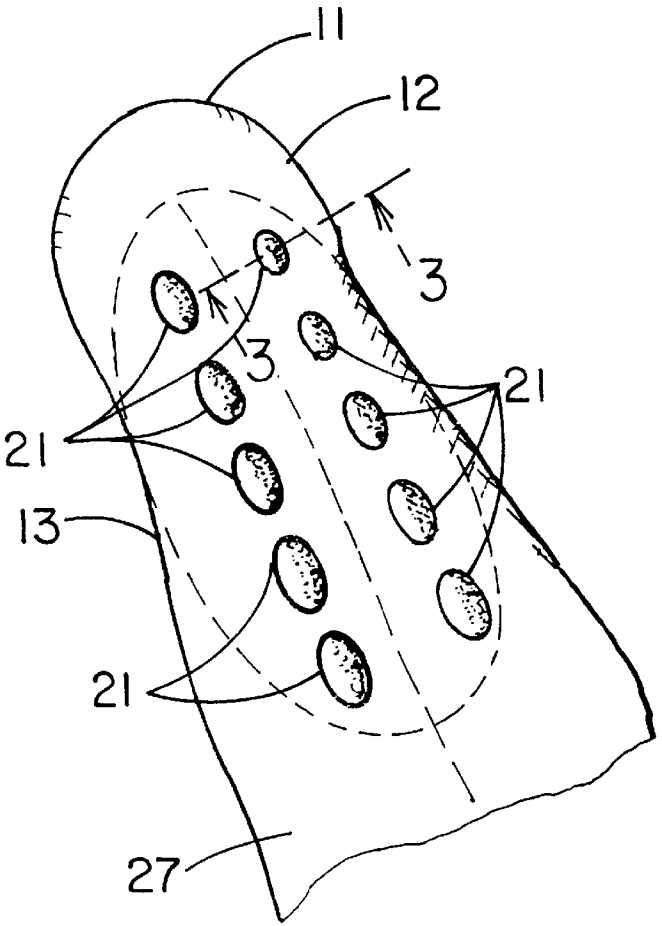
FIG. 2 is a detailed side elevational view of one of the finger portions of the present invention.

With reference now to the drawings, and in particular to FIGS. 1 through 3 thereof, a new massaging glove assembly embodying the principles and concepts of the present invention and generally designated by the reference numeral 10 will be described.

As best illustrated in FIGS. 1 through 3, the massaging glove assembly 10 generally comprises a glove 11 being made of a sheet of material and having a hand portion 28 and a plurality of finger portions 12 and a thumb portion 14 being conventionally extended from the hand portion 28. The glove 11 also includes a plurality of arcuate flanges 18 being integrally attached to the glove 11 and being arranged in pairs with each of the pairs of arcuate flanges 18 being spaced apart to form a socket 20 therebetween. The pairs of the arcuate flanges 18 are disposed upon and spaced along end portions 13,15 of the finger portions 12 and the thumb portion 14, and the arcuate flanges 18 are disposed upon a palm side 27 of the end portions 13,15 of the finger portions 12 and the thumb portion 14 with each of the arcuate flanges 18 having a tapered end 19. The pairs of the arcuate flanges 18 are arranged in rows upon the end portions 13,15 with the rows being longitudinally disposed along a length of the end portions 13,15.

A plurality of balls 21 are movably disposed upon the end portions 13,15 of the finger portions 12 and the thumb portion 14 with each of the balls 21 being rollably and conventionally received in a respective socket 19.

A vibrating assembly is conventionally attached to the glove 11 for vibrating the balls 21. The vibrating assembly includes a conventional vibrating member 22 being securely and conventionally disposed upon a cuff portion 16 of the glove 11 and being conventionally connected with wires 17 to the end portions 13,15 of the finger portions 12 and the thumb portion 14 about the balls 21, and also includes an on/off switch 25 being movably and conventionally disposed through a slot 23 in the cuff portion 16 of the glove 11, and further includes a battery 26 being removably and conventionally disposed in the cuff portion 16 through an opening 24 in the cuff portion 16 and being conventionally connected to the on/off switch 25 and to the vibrating member 22. The glove 11 further includes a cover 29 being removably and conventionally disposed over the opening 24 in the cuff portion 16 of the glove 11 with the slot 23 and the opening 24 being disposed upon the palm side 27 of the glove 11.

In use, a person would slip the glove 11 on one's hand and turn on the on/off switch 25 to energize the vibrating member 22 which vibrates the balls 21, and that person would move one's hand with the glove 11 over another person's body to soothe and massage various parts of the other person's body.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A massaging glove assembly comprising:

a glove having a hand portion and a plurality of finger portions and a thumb portion being extended from said hand portion;

a plurality of balls being movably disposed upon end portions of said finger portions and said thumb portion; and a vibrating assembly being attached to said glove for vibrating said balls;

wherein said glove also includes a plurality of arcuate flanges being integrally attached to said glove and being arranged in pairs with each of said pairs of arcuate flanges being spaced apart to form a socket therebetween.

2. A massaging glove assembly as described in claim 1, wherein said pairs of said arcuate flanges are disposed upon and spaced along said end portions of said finger portions and said thumb portion.

3. A massaging glove assembly as described in claim 1, wherein said arcuate flanges are disposed upon a palm side of said end portions of said finger portions and said thumb portion.

4. A massaging glove assembly as described in claim 1, wherein each of said balls is rollably received in a respective said socket.

5. A massaging glove assembly as described in claim 1, wherein said pairs of said arcuate flanges are arranged in rows upon said end portions, said rows being longitudinally disposed along a length of said end portions.

6. A massaging glove assembly as described in claim 1, wherein said vibrating assembly includes a vibrating member being disposed upon a cuff portion of said glove and being connected with wires to said end portions and about said balls, and also includes an on/off switch being movably disposed through a slot in said cuff portion of said glove, and further includes a battery being removably disposed in said cuff portion through an opening in said cuff portion and being connected to said on/off switch and to said vibrating member.

7. A massaging glove assembly as described in claim 6, wherein said glove further includes a cover being removably disposed over said opening in said cuff portion of said glove, said slot and said opening being disposed upon said palm side of said glove.

8. A massaging glove assembly comprising:

a glove having a hand portion and a plurality of finger portions and a thumb portion being extended from said hand portion; said glove also including a plurality of arcuate flanges being integrally attached to said glove and being arranged in pairs with each of said pairs of arcuate flanges being spaced apart to form a socket therebetween, said pairs of said arcuate flanges being disposed upon and spaced along said end portions of said finger portions and said thumb portion, said arcuate flanges being disposed upon a palm side of said end portions of said finger portions and said thumb portion, each of said arcuate flanges having a tapered end, said pairs of said arcuate flanges being arranged in rows upon said end portions, said rows being longitudinally disposed along a length of said end portions;

a plurality of balls being movably disposed upon end portions of said finger portions and said thumb portion, each of said balls being rollably received in a respective said socket; and a vibrating assembly being attached to said glove for vibrating said balls, said vibrating assembly including a vibrating member being disposed upon a cuff portion of said glove and being connected with wires to said end portions and about said balls, and also including an on/off switch being movably disposed through a slot in said cuff portion of said glove, and further including a battery being removably disposed in said cuff portion through an opening in said cuff portion and being connected to said on/off switch and to said vibrating member, said glove further including a cover being removably disposed over said opening in said cuff portion of said glove, said slot and said opening being disposed upon said palm side of said glove.

* * * * *